United States Patent [19]

Nakamura et al.

[11] Patent Number: 4,908,304

[45] Date of Patent: Mar. 13, 1990

[54] SILVER HALIDE PHOTOGRAPHIC LIGHT-SENSITIVE ELEMENT

[75] Inventors: Shinichi Nakamura, Tokyo; Toshiaki Shibue, Hino, both of Japan

[73] Assignee: Konishiroku Photo Industry Co., Ltd., Tokyo, Japan

[21] Appl. No.: 352,653

[22] Filed: May 12, 1989

Related U.S. Application Data

[63] Continuation of Ser. No. 178,878, Mar. 31, 1988, abandoned, which is a continuation of Ser. No. 861,570, May 9, 1986, abandoned, which is a continuation-in-part of Ser. No. 776,296, Sep. 16, 1985, abandoned.

[30] Foreign Application Priority Data

Sep. 21, 1984 [JP] Japan ..... 59-198845

[51] Int. Cl.[4] ..... G03C 1/06

[52] U.S. Cl. ..... 430/615; 430/538; 430/600; 428/323; 428/481; 427/44

[58] Field of Search ..... 430/538, 615, 532, 935, 430/942, 600; 427/44; 428/323, 481; 156/272

[56] References Cited

U.S. PATENT DOCUMENTS

| | | | |
|---|---|---|---|
| 4,011,083 | 3/1977 | Durning et al. | 96/109 |
| 4,078,937 | 3/1978 | Tani et al. | |
| 4,302,525 | 11/1981 | Baker et al. | 430/217 |
| 4,364,971 | 12/1982 | Sack et al. | 427/44 |
| 4,384,040 | 5/1983 | Meer | 430/532 |
| 4,485,169 | 11/1984 | Ishiguro et al. | 430/615 |
| 4,542,094 | 9/1985 | Koshizuka et al. | 430/569 |
| 4,594,315 | 1/1986 | Shibu et al. | 430/538 |

FOREIGN PATENT DOCUMENTS

| | | |
|---|---|---|
| 2078236 | 1/1982 | United Kingdom |

*Primary Examiner*—Jack P. Brammer

*Attorney, Agent, or Firm*—Jordan B. Bierman

[57] ABSTRACT

This invention is a silver halide photographic light-sensitive material comprising a paper support bearing thereon at least one silver halide emulsion layer containing a hydroxytetrazaindene.

5 Claims, No Drawings

SILVER HALIDE PHOTOGRAPHIC LIGHT-SENSITIVE ELEMENT

This application is a continuation of application Ser. No. 178,878, filed Mar. 31, 1988, now abandoned. which is a continuation of application Ser. No. 861,570, filed May 9, 1986, now abandoned. which is a continuation-in-part of application Ser. No. 776,296, filed Sept. 16, 1985, now abandoned; which, in turn, claims the priority of Japanese 198845/1984, filed Sept. 21, 1984.

BACKGROUND OF THE INVENTION

The invention relates to a silver halide photographic light-sensitive material, and particularly to a color printing paper capable of obtaining printed images, and further detailedly to a color printing paper which is extremely less in fog and excellent in imaging characteristics.

In the prior art, a baryta paper was used, at the beginning, to serve as the support of a photographic printing paper. However, this kind of paper supports is not a little deficient. Namely, (1) paper will expand and contract; (2) a paper washing step will require a lot of time to remove a processing liquid because the processing liquid will permeate the paper; and (3) a ferrotyping treatment is required to dry up the paper, so that the installations and the energy burdens therefor may become expensive. With the purpose of improving the described deficiencies, the so-called polyolefin-laminated paper has been practically put in use, in which such a resin film as a polyethylene film is laminated on a paper support. This type of the supports comprises an intermediate paper mainly comprising a natural pulp, and a resin film layer for laminating the both surfaces of the intermediate paper. A variety of additives are added to the described natural pulps so as to improve the characteristics of such paper support. For example, Japanese Patent Publication Open to Public Inspection (hereinafter referred to as Japanese Patent O.P.I. Publication) No. 54436/1981 and the like each describe that there may be added with a dry paper strengthener, a sizing agent, a filter, a wet paper strengthener, a fixer, a pH adjuster, a dyestuff, an optical brightening agent and the like. With the purpose of improving the whiteness, titanium dioxide, a pigment and the like may be added to the lamination layer on the side to which an emulsion is to be coated.

It was found that the above described polyolefin-laminated paper was also not a little deficient. Namely, (1) the surface thereof is poor in smoothness; (2) the commercial value thereof is lowered because the pulp fibre stretches beard-like at the cut ends; (3) even if titanium dioxide is tried to add in an adequate amount to a polyolefin layer so as to improve the whiteness and the image sharpness of a printing paper, the amount of titanium dioxide to be added is limited to only 20% at a maximum; (4) the cut ends of a printing paper will be capable of hardening the surface of an intermediate paper when irradiating an electron beam thereto. Still in these methods, it was found a further deficiency that, when storing a printing paper prepared by coating an emulsion to the described support, there seriously affects such an emulsion characteristics as that the sensitivity of the printing paper is varied and a fog is increased and so on. The reason why the above-mentioned deficiency is caused is still not known yet, however, it may be presumed that the reason thereof may be that a compound having been contained in a printing paper is changed into a photographically active compound by the irradiation of an electron beam, and the resulting compound passes through a resin layer and immigrates into a photographic emulsion layer so that a fog core is formed.

With the purpose of compensating the above-mentioned deficiency, West German Patent (OLS) No. 3,046,130 Japanese Patent O.P.I. Publication No. 124336/1984 and the like describe respectively such a method that a polyolefin layer is used in combination with a hardened resin layer so as to serve as an interrupting layer. However, these methods can display only such an unsatisfactory effect that a time of causing a fog can only be delayed to some extent, and in addition, in these methods, the layer arrangement of the support will be increased, so that it is disadvantageous from the viewpoints of the costs and steps in manufacture.

SUMMARY OF THE INVENTION

It is an object of the invention to provide a photographic light-sensitive material having a support comprising an electron-beam hardening resin coated paper, and more particularly to a color printing paper which is capable of remarkably reducing the occurrence of a fog caused in the preservation thereof and displaying excellent imaging characteristics.

Effect of the Invention

Electron-beam hardening resin coated paper has many advantages compared with polyolefin-laminated paper but it also has a disadvantage that the photographic fog is caused in the emulsion layer by the irradiation of electron-beam. This disadvantage is overcome by adding tetrazaindene compounds to the emulsion layer or to the non-emulsion layer and following effects are obtained.

(1) Light-sensitive materials whose image performance is better than that of polyolefin-laminated paper may be obtained.

(2) It is not necessary to keep the light-sensitive materials in a cooled storehouse where the temperature is 10° C. and below.

(3) A wide range for the selection of the paper support made from pulp and of the additives such as sizing agent favorably affects the improvement in physical properties and the cost reduction.

(4) Distinguishing features such as an excellence in smoothness, sharpness and heat-resistance of electron-beam hardening resin coated paper may sufficiently be demonstrated.

Constituents of the Invention

The present invention have devoted themselves in a variety of experiments and studies one after another, and consequently they have achieved the above-mentioned object of the invention in the process that a certain kind of tetrazaindene compounds is added to a silver halide emulsion layer or a non-light-sensitive layer which is to be coated onto an electron-beam hardening resin coated paper.

DETAILED DESCRIPTION OF THE INVENTION

The constituents of the invention will now be detailedly described below:

The support of the invention is a paper support covered with a resin hardened by irradiating thereto an electron beam. The supports which are normally preferred are those prepared in such a manner that a monomer, an oligomer, a polymer or the mixture thereof having the property of being hardened by irradiating an electron beam is added with the other additives if required, and the resulting matter is coated onto one side or the both sides of a paper support applied with a sizing treatment of from 100 to 250 g/m$^2$ in basis weight, and thereafter an electron-beam is irradiated thereto so that the resulting coated layer may be hardened. This type of the methods are described in Japanese Patent O.P.I. Publication Nos. 27257/1982, 30830/1982, 49946/1982, 124336/1984 and the like. In the constitution of the invention, it is also allowed that a further layer, for example, a polyolefin layer, may be interposed between an electron-beam hardening resin layer and a paper support or provided to the outside thereof, if required.

Any normal type of photographic printing papers may be used for the paper supports of the invention, and it is, however, particularly preferred to use such a paper that does not induce any oxidizing or reducing substance which may affect the photographic characteristics of the printing paper when an electron-beam is irradiated.

An electron-beam hardening resin coated layer may contain, if required, various additives including, for example, a pigment, a dye stuff, a whitening agent, a softening agent, an electrolyte and others, and the electron-beam hardening resin coated layer on an emulsion layer side, in particular, may contain titanium dioxide, zirconium oxide, zinc oxide, zinc sulfide, antimony oxide, barium sulfide, calcium carbonate and the like with the purpose of improving the photographic image quality to be obtained after processing, and inter alia, titanium dioxide is particularly effective for the above-mentioned purpose. The more these white pigments are added, the more the sharpness of an photographic image can be improved. Nevertheless, it is preferred to be added in an amount thereof from 10 to 60% by weight per the resin coated layer, and more preferred to be added 40 to 60% by weight, from the viewpoint of the dispersibility thereof in the electron-beam hardening resin coated layer. The amount added thereof is far more advantageous than in the case that an amount thereof of from 10 to 20% by weight is added in the conventional polyolefin-coated papers.

The electron-beam hardening resins capable of being used in the invention include, for example, those described in the above-referred Japanese Patent O.P.I. Publications and Japanese Patent Application Nos. 53042/1983, 174980/1983, 275885/1983, 32237/1984 and the like.

The suitable thickness of a resin layer is from 10 to 40 g/m$^2$ on the each surface. If the thickness thereof is thinner than the above, it is not preferable from the viewpoint of the practical use, because the smoothness of the surfaces of the paper is getting deteriorated according to the texture of the paper, and on the other hand, if the thickness thereof is too thickened, the whole thickness of the printing paper is getting thickened so that it will be not only impractical but also expensive both in use and cost, therefore, it is disadvantageous too from the commercial viewpoint.

The supports of the invention may be applied with a subbing process, a corona impulse treatment or the like onto the surface of the support, so that s silver halide emulsion layer or non-light-sensitive layer may be coated on the surface thereof. Further, a variety of treatments such as an antistatic treatment, a write enabling treatment and the like may also be applied to the back surface of the support.

On the supports, there are coated with single or a plurality of silver halide emulsion layers and such a photographic component layer as an interlayer or a protective layer.

The typical examples of the hydroxytetrazaindene compounds which are capable of being used in the invention are given below. It is, however, to be understood that the compounds to be used in the invention shall not be limited thereto.

Compound I: 4-hydroxy-6-methyl-1,3,3a,7-tetrazaindene

Compound II: 4-methyl-6-hydroxy-1,3,3a,7-tetrazaindene

Compound III: 4-hydroxy-6-methyl-1,2,3a,7-tetrazaindene

Compound IV: 4-hydroxy-1,3,3a,7-tetrazaindene

Compound V: 2-ethyl-4-hydroxy-6-phenyl-1,3,3a,7-tetrazaindene

Compound VI: 2,6-dimethyl-4-hydroxy-1,3,3a,7-tetrazaindene

Compound VII: 2,6-dimethyl-4-hydroxy-5-ethyl-1,3,3a,7-tetrazaindene

Compound VIII: 2-phenyl-4-hydroxy-6-methyl-1,3,3a,7-tetrazaindene

Compound IX: 4-hydroxy-5-ethyl-6-methyl-1,3,3a,7-tetrazaindene

Compound X: 4-hydroxy-6-phenyl-1,3,3a,7-tetrazaindene

Compound XI: 2-benzyl-4-hydroxy-6-phenyl-1,3,3a,7-tetrazaindene

Compound XII: 2-mercaptomethyl-4-hydroxy-6-methyl-1,3,3a,7-tetrazaindene

Compound XIII: 4-methyl-6-hydroxy-1,2,3a,7-tetrazaindene

Compound XIV: 4-hydroxy-6-phenyl-1,2,3a,7-tetrazaindene

Compound XV: 4-hydroxy-1,2,3a,7-tetrazaindene

Compound XVI: 3-carboxymethylthio-4-methyl-6-hydroxy-1,2,3a,7-tetrazaindene

The hydroxytetrazaindene compounds to be used in the invention may be added in an amount that a fog may satisfactorily be inhibited to cause in an emulsion. The amount added thereof will vary in a wide range according to the conditions of the emulsion and the layers to which the compounds are dded. Nevertheless, it is preferred to add such compounds in an amount within the range of from 0.001 to 0.5 mol per mol of the silver halide used, and more preferred to add in an amount within the range of from 0.01 to 0.2 mol.

Such hydroxytetrazaindene compounds represented by the abovegiven examples may be added to an emulsion within the above-mentioned range either independently or in combination, provided that in the latter case the total amount added is to be within the above-mentioned range.

How to add these compounds to an emulsion may be in accord with the ordinary methods of adding the additives for photographic emulsions. For example, such compounds is dissolved in a suitable solvent including, e.g., water or an alkaline aqueous solution, which does not effect a light-sensitive material as a final product, by a harmful effect, and the resulting solution is to be added.

In addition, the above-mentioned compounds may be added not only to an emulsion layer but also to a non-light-sensitive photographic component layer. The time of adding such compounds may be any time in the beginning, in course or in completion of a chemical ripening process.

The silver halide color photographic light-sensitive materials relating to the invention normally comprise three kinds of light-sensitive silver halide emulsion layers different each other in spectral sensitivity, and each of the emulsion layers may be able to contain one of the three kinds of couplers, i.e., a yellow coupler, magenta coupler and a cyan coupler.

In the combination of a light-sensitive silver halide emulsion layer and a coupler in this case, there are normally combined red-light-sensitive silver halide emulsion layer with a cyan coupler a green-light-sensitive emulsion layer with a magenta coupler; and a blue-light-sensitive silver halide emulsion layer with a yellow coupler. There is, however, no special limitation to the coating order of each of the emulsion layers.

To serve as the yellow, magenta and cyan couplers which are to be used in the invention, any well-known one may be used for.

The preferable yellow couplers include, for example, a series of benzoylacetanilide couplers and of pivaloylacetanilide couplers. The preferable magenta couplers include, for example, a series of 1-phenyl-3-anilino-5-pyrazolone couplers and of pyrazolotriazole couplers. The preferable cyan couplers include, for example, a series of phenol couplers. It is preferred that a silver halide emulsion layer contains these couplers in an amount of the order of from 0.05 to 1 mole% per mole of the silver halide used.

The silver halide color photographic light-sensitive materials relating to the invention may be provided on the supports thereof with non-light-sensitive layers such as protective layers, interlayers, filter layers, scavenger layers and the like which are suitably arranged in desired order and number of layers, as well as the aforementioned silver halide emulsion layers.

The silver halide contained in the silver halide emulsion layers capable of being used in the invention may be anyone of silver iodobromide, silver chlorobromide, silver bromide, silver chloroiodobromide, silver chloride or silver chloroiodide, or anyone of the mixtures thereof. The above-mentioned silver halide may be those prepared in anyone of an ammonia method, a neutralized method, an acidifying method or the like and, further, those prepared in anyone of a double jet method, a normal precipitation method, a reverse precipitation method, a conversion method or the like, and besides the above, any silver halide having or not having a boundary between the different halogen compositions inside the silver halide particles may also effectively be used.

The most popular binder which is used in the component layers of the silver halide color photographic light-sensitive materials relating to the invention is such a gelatin as an alkaline-processed gelatin, an acid-processed gelatin or the like. Meanwhile, such a derivative gelatin as phthalated gelatin or a phenylcarbamoyl gelatin, albumin, agar-agar, gum arabic, alginic acid, a partially hydrolyzed cellulose derivative, a partially hydrolyzed polyvinyl acetate, a polyacrylamide, a polyvinyl alcohol, a polyvinyl pyrolidone, and the copolymers of the above-mentioned vinyl compounds may be used in combination with a part of the aforementioned gelatins.

The silver halide emulsions capable of being used in the invention may be applied with such a chemical sensitization as a noble-metal sensitization to be made with the salts of such a noble-metal as ruthenium, rhodium, palladium, iridium, platinum, gold or the like, that is, to be more concrete, ammonium chloropalladate, potassium chloroplatinate, potassium chloropalladide, potassium chloroaurate and the like; a sulfur sensitization to be made with an active gelatin, and such an instable sulfur compounds as sodium thiosulfate and the like; a selenium sensitization to be made with a selenium compounds; a reduction sensitization to be made with a stannous salt, a polyamine or the like, under the low pAg conditions.

In addition to the above, the above-mentioned silver halide emulsions may be optical-sensitized by making use of a variety of sensitizing dyes, with the purpose of endowing them with a light-sensitive in a desired spectral wavelength region. The preferable sensitizing dyes capable of being used in this instance include, for example, cyanine dyes, merocyanine dyes, a compound cyanine dye in the independent form or in combination thereof. With the other purposes than the original purpose, the above-mentioned various optical-sensitizers may also be used, for example, to prevent a fog and to prevent the deteriorations of photographic characteristics which may be caused in preservation of a silver halide color photographic light-sensitive material, and further to control the development thereof such as a gradation control and the like.

There may also be added in the component layers of the silver halide color photographic light-sensitive materials relating to the invention with a variety of photographic additives including, for example, an ultraviolet-ray absorbing agent such as a benzophenone compound and a benzotriazole compound; a dye-image stabilizer such as a phenol compound, a bisphenol compound, a hydroxychroman compound, a bisspirochroman compound, a hydantoin compound, a dialkoxybenzene compound and the like; a stain preventive such a hydroguinone derivative and the like; a surfactant such as sodium alkylnaphthalene sulfonate, sodium alkylbenzene sulfonate, sodium alkylsuccinate sulfonate, a polyalkylene compound and the like; a water-soluble irradiation preventive such as an azo compound, a styryl compound, an oxonol compound, a triphenylmethane compound and the like; a hardener such as a halogen-substituted S-triazine compound, an active vinyl compound, an ethyleneimino compound, an epoxy compound, a water-soluble aluminium salt and the like; and a physical property improving agent for layers such as glycerol, a polyalkylene glycol, a polymerized water-dispersed matter, i.e., a latex, a solid or liquid paraffin and the like.

Each of the component layers of a silver halide color photographic light-sensitive material is coated on the support of the invention in such a popularly-known coating method as an impregnation coating, roller coating, bead coating, curtain flow coating or the like method, and is then dried. In order to obtain a dye-image from a silver halide color photographic light-sensitive material of the invention, an imagewise exposure is made and then, if required, a color-developing process is carried out. Such process basically includes a series of the steps of a color development and a bleach-fixation. In the case, there may be some instance where each of the steps may be independently carried uut, or where no less than two steps thereof may be carried out at the same time by making use of a processing liquid capable of carrying out the steps at a time. It is also possible to divide each of the steps into not less than two sub-steps, if required. Besides the above-mentioned steps, a prehardening step, a neutralizing steps, a first developing step for a black-and-white development, an image-stabilizing step, a washing step, and other various steps may be combined in the above-mentioned processing steps, if required. A processing temperature is to be fixed within a desired range according to a light-sensitive material and a processing formula used, and it is generally fixed at a temperature of from 20° C. to 60° C. As for a silver halide color photographic light-sensitive material relating to the invention, a processing temperature of not lower than 30° C. is particularly suitable for processing it.

The color developing agents which are to be used for a color development include, for example, those which have so far been well known and popularly used in a variety of the color photographic processes. The particularly useful color developing agent among them is an N,N-dialkyl-p-phenylenediamine compound, and the alkyl group and the phenyl group thereof may be substituted or unsubstituted. Among these compounds, the particularly useful ones include, for example, an N,N-diethyl-p-phenylenediamine chloride, an N-methyl-p-phenylenediamine chloride, an N,N-dimethyl-p-phenylenediamine chloride, a 2-amino-5-(N-ethyl-N-dodecylamino)-toluene, an N-ethyl-N-β-methansulfonamidoethyl-3-methyl-4-aminoaniline sulfate, an N-ethyl-N-β-hydroxyethylaminoaniline sulfate, a 4-amino-3-methyl-N,N-diethylaniline sulfate, an N-ethyl-N-β-hydroxylethyl-3-methyl-4-aminoaniline sulfate, a 4-amino-N-(β-methoxyethyl)-N-ethyl-3-methylaniline-p-toluene sulfonate, an N,N-diethyl-4-amino-3-(β-methanesulfonamidoethyl)aniline sulfate, and the like. Among these exemplified compounds, the more preferably useful ones include, for example, an N-ethyl-β-methanesulfonamidoethyl-3-methyl-4-aminoaniline sulfate, a 4-amino-3-methyl-N,N-diethylaniline chloride, a 4-amino-N-(β-methoxyethyl)-N-ethyl-3-methylaniline-p-toluene sulfonate, and an N,N-diethyl-4-amino-3-(β-methanesulfonamidoethyl)aniline sulfate.

A variety of additives may be added, if required, to a color developing liquid. For example, such additives include an alkalizer such as the hydroxide, carbonate or tertiary phosphate of an alkali metal, and the like; a buffer such as boric acid, acetic acid and the like; a development accelerator such as thioether, 1-aryl-3-pyrazolidone, N-methyl-p-aminophenol, polyalkylene glycol and the like; an organic solvent such as benzyl alchol, ethylene glycol, methanol, acetone and the like; a development inhibitor such as potassium bromide, nitrobenzimidazole and the like; a preserving agent such as a sulfite, hydroxylamine, glucose, Alkanol amine, and the like; and a water softener such as a polyphosphoric acid compound, nitrilotriacetic acid, and the like.

EXAMPLES

The invention will be described more concretely with reference to the following examples. However it is to be understood that the invention is not intended to be limited to the specific examples.

Example 1

Yellow couplers Y-1 and antioxidants HQ-1 represented by the following formulas Y-1 and HQ-1 were dissolved into the solution of ethyl acetate and dioctylphthalate. The resulting solution was added to a 3.5% aqueous solution of gelatin containing sodium diisopropyl-naphthalene sulfonate and was emulsion-dispersed by a homogenizer. Thus obtained dispersion solution was added to a blue-sensitive silver chlorobromide emulsion containing 20 mol% silver chloride (average grain size 0.7μ) into which fog restrainers of the invention or the comparison were added variously as described in Table 1.

Y-1

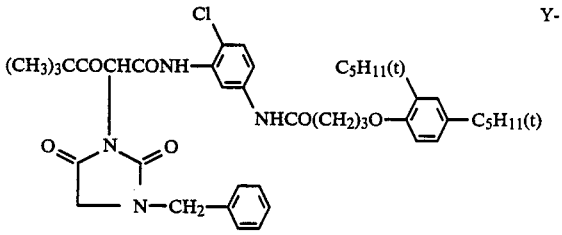

HQ-1

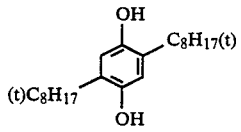

The emulsion and the coating solution for a protective layer the constitution of which will be described hereunder were simultaneously coated onto a polyolefin laminated paper and a electron-beam hardening resin coated paper respectively. Thus Sample No. 1 to No. 16 were obtained.

Coating Solution for a Protective Layer

Hardeners represented by the following formula H-1 were added immediately before coating into a 3.9% aqueous solution of gelatin containing 1 g of sodium diisopropyl-naphthalene sulfonate per liter in an amount of 14 mg per gram of gelatin. Thus a coating solution for a protective layer was prepared.

H-1

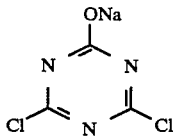

Electron-beam hardening resin coated papers were prepared by the method disclosed in Japanese Patent O.P.I. Publication No. 27257/1982 Example No. 1 to No. 7.

Coating was so made that the coating amount of gelatin was 2.5 g per square meters of an emulsion layer and 1.2 g per square meters of a protective layer. The amount of silver halide in an emulsion layer was 0.45 per square meters in terms of silver. Thus obtained samples were kept at 30° C. and 60%RH for ten days, exposed with an optical wedge and then processed for color development in the following steps and processing solution. A part of each sample were exposed and developed right after coating and drying to get the data on the same day.

| Processing step (at 33° C.) | |
|---|---|
| Color development | 3 min. 30 sec. |
| Bleach fixing | 1 min. 30 sec. |
| Washing | 3 min. |
| Drying | 60 to 80° C. |
| <Color developer> | |

-continued

| | |
|---|---|
| Pure water | 800 ml |
| ethylene glycol | 15 ml |
| benzyl alcohol | 15 ml |
| Whitex BBconc (optical bleaching agent mfd. by Sumitomo Chemical Co., Ltd.) | 1 g |
| hydroxylamine sulfate | 3 g |
| 3-methyl-4-amino-N—ethyl-N—(β-methanesulfonamidethyl)aniline sulfate | 4.5 g |
| potassium carbonate (anhydride) | 30 g |
| potassium sulfite (anhydride) | 2.0 g |
| potassium bromide | 0.65 g |
| 1-hydroxyethylidene-1,1-diphosphonate (60% aqueous solution) | 2 ml |
| Add water to make 1 l and adjust pH value to 10.1 with sulfuric acid or potassium hydroxide. | |
| <Bleach and fix> | |
| pure water | 600 ml |
| ethylenediaminetetraacetic acid-2-sodium.$2H_2O$ | 25 g |
| ammonium sulfite (40% aqueous solution) | 35 ml |
| ammonium thiosulfate (70% aqueous solution) | 150 ml |
| iron (III) ammonium ethylenediaminetetraacetate | 95 g |
| aqueous ammonia (28%) | 25 ml |
| Add water to make 1 l and adjust pH value to 6.9 with aqueous ammonia or glacial acetic acid. | |

Samples developed were measured for fog density with Sakura Color Densitometer PDA-60 (mfd. by Konishiroku Photo Ind. Co., Ltd.). The results are shown in Table 1.

TABLE 1

| Sample No. | Support | Compound added | Amount added mol/molAgX | Fog density instant | Fog density passage of time |
|---|---|---|---|---|---|
| 1 | Polyolefin laminated paper | Comparative 1 | 0.01 | 0.05 | 0.08 |
| 2 | Polyolefin laminated paper | Comparative 1 | 0.1 | 0.05 | 0.06 |
| 3 | Polyolefin laminated paper | Comparative 2 | 0.01 | 0.05 | 0.12 |
| 4 | Polyolefin laminated paper | Comparative 2 | 0.1 | 0.06 | 0.07 |
| 5 | Polyolefin laminated paper | Exemplified I | 0.01 | 0.05 | 0.12 |
| 6 | Polyolefin laminated paper | Exemplified I | 0.1 | 0.05 | 0.10 |
| 7 | Polyolefin laminated paper | Exemplified II | 0.01 | 0.05 | 0.13 |
| 8 | Polyolefin laminated paper | Exemplified II | 0.1 | 0.05 | 0.09 |
| 9 | Electron-beam hardening resin coated paper | Comparative 1 | 0.01 | 0.18 | 0.43 |
| 10 | Electron-beam hardening resin coated paper | Comparative 1 | 0.1 | 0.16 | 0.38 |
| 11 | Electron-beam hardening resin coated paper | Comparative 2 | 0.01 | 0.19 | 0.46 |
| 12 | Electron-beam hardening resin coated paper | Comparative 2 | 0.1 | 0.17 | 0.39 |
| 13 | Electron-beam hardening resin coated paper | Exemplified I | 0.01 | 0.07 | 0.09 |
| 14 | Electron-beam hardening resin coated paper | Exemplified I | 0.1 | 0.05 | 0.05 |
| 15 | Electron-beam hardening resin coated paper | Exemplified II | 0.01 | 0.07 | 0.09 |
| 16 | Electron-beam hardening resin coated paper | Exemplified II | 0.1 | 0.04 | 0.05 |

Comparative compound 1

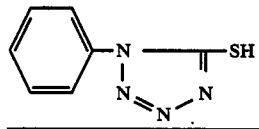

Comparative compound 2

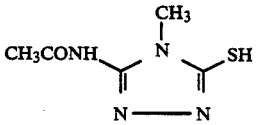

As is obvious from Table 1, Samples No. 13 to No. 16 of the invention is much lower in fog density than Comparative Samples No. 9 to No. 12, and particularly have almost no fog increase during storage at 30° C. Further, smaller adding amount is effective than in the case of using polyolefin laminated paper.

Example 2

Coating samples No. 17 to No. 32 were prepared in the same manner as in Example 1, except that instead of yellow coupler, magenta coupler M-1 represented by the following formula M-1 was used and that instead of a blue-sensitive emulsion, a green-sensitive silver chlorobromide containing 60 mol% silver chloride (average grain size 0.5μ). Into the emulsion were added compounds of the invention and comparative compounds different from those of Example 1 in various amounts as in shown in Table 2.

M-1

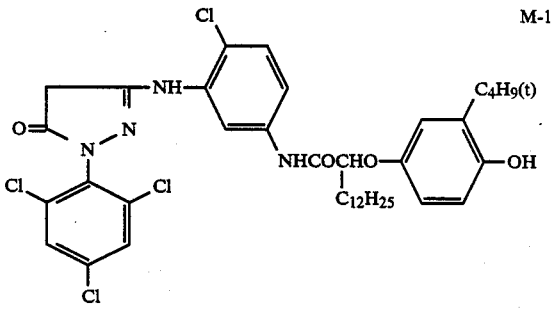

As an electron-beam hardening resin coated paper, the one described in Japanese Patent O.P.I. Publication No. 124336/1984 was used. Namely, the photographic paper size-treated in the inside thereof with alkali ketene dimer and polyamide epichlorohydrin resin, having the weight of 150 g/m² and a surface size obtained from anionic starch and sodium chloride was covered with polyethylene mixture to a level of about 10 g/m² by means of an extrusion covering. The polyethylene mixture contained about 10% by weight of titanium dioxide and 0.2% by weight of cobalt violet pigment.

The polyethylene surface of the paper thus covered in advance was given a corona treatment and both sides thereof were covered with the electron-beam hardenable mixture having the following composition to a level of 25 g/m² through the method disclosed in West German OLS Patent No. 3,022,709 and then solidified by the irradiation of electron beam.

| <electron-beam hardenable composition> | |
|---|---|
| polyesteracrylate (average molecular weight, approx. 1000, 4 acrylic groups per one molecule) | 29% by weight |
| oligotriacrylate | 9% by weight |
| hexanedioldiacrylate | 6% by weight |
| N—vinylpyrrolidone | 6% by weight |
| titanium dioxide | 50% by weight |

Each sample to be coated was stored and then was subjected to the exposure and development. After that, the fog density of each sample was measured and the results of measurement are shown in Table-2.

TABLE 2

| Sample No. | Support | Compound added | Amount added mol/molAgX | Fog density instant | Fog density passage of time |
|---|---|---|---|---|---|
| 17 | Polyolefin laminated paper | Comparative 3 | 0.01 | 0.04 | 0.08 |
| 18 | Polyolefin laminated paper | Comparative 3 | 0.1 | 0.04 | 0.07 |
| 19 | Polyolefin laminated paper | Comparative 4 | 0.01 | 0.05 | 0.07 |
| 20 | Polyolefin laminated paper | Comparative 4 | 0.1 | 0.03 | 0.07 |
| 21 | Polyolefin laminated paper | Exemplified III | 0.01 | 0.04 | 0.08 |
| 22 | Polyolefin laminated paper | Exemplified III | 0.1 | 0.03 | 0.07 |
| 23 | Polyolefin laminated paper | Exemplified IV | 0.01 | 0.04 | 0.07 |
| 24 | Polyolefin laminated paper | Exemplified IV | 0.1 | 0.03 | 0.07 |
| 25 | Electron-beam hardening resin coated paper | Comparative 3 | 0.01 | 0.10 | 0.40 |
| 26 | Electron-beam hardening resin coated paper | Comparative 3 | 0.1 | 0.08 | 0.32 |
| 27 | Electron-beam hardening resin coated paper | Comparative 4 | 0.01 | 0.09 | 0.39 |
| 28 | Electron-beam hardening resin coated paper | Comparative 4 | 0.1 | 0.09 | 0.32 |
| 29 | Electron-beam laminated paper | Exemplified III | 0.01 | 0.03 | 0.04 |
| 30 | Electron-beam laminated paper | Exemplified III | 0.1 | 0.03 | 0.03 |
| 31 | Electron-beam laminated paper | Exemplified IV | 0.01 | 0.04 | 0.04 |
| 32 | Electron-beam laminated paper | Exemplified IV | 0.1 | 0.03 | 0.03 |

TABLE 2-continued

| Sample No. | Support | Compound added | Amount added mol/molAgX | Fog density instant | Fog density passage of time |
|---|---|---|---|---|---|
| | | Comparative compound 3 | | Comparative compound 4 | |

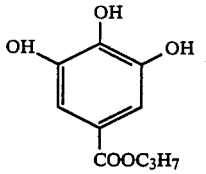

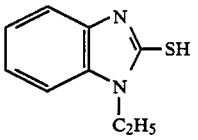

Electron-beam hardening resin coated paper used in the present example has a polyethylene shielding layer between a resin layer and a paper layer for the purpose of preventing the diffusion of fog-causing substance and thereby the occurrence of photographic fog on the 'instant' basis is considerably reduced but the samples 25~28 are extremely greater than the samples 17~24 in the fog increase for the storage on the 'passage of time' basis and therefore the samples 25~28 are not of practical use. On the contrary, the samples 29~32 concerned in the present invention hardly show the fog increase for the storage on a 'passage of time' basis and they even show the results better than those of polyolefin-laminated paper.

Example 3

Following layers were formed by coating in the order of the following list on polyethylene-laminated paper and on electron-beam hardening resin coated paper and thus, color photographic light-sensitive materials were prepared. (Amount to be added represents the one per 1 $m^2$ unless otherwise explained and silver halide emulsion is shown in silver equivalent.)

layer 1: a blue-sensitive emulsion layer containing 2 g of gelatin, 0.042 g of blue-sensitive silver chlorobromide emulsion (silver chloride, 10 mol%) and 0.6 g of dioctylphthalate wherein 0.83 g of yellow coupler (Y-2) and 0.01 g of HQ-1 are dissolved.

layer 2: a first intermediate layer containing 1.2 g of gelatin and 0.2 g of dioctylphthalate wherein 0.05 g of HQ-1 is dissolved.

layer 3: a green-sensitive silver chlorobromide emulsion containing 1.9 g of gelatin, 0.040 g of green-sensitive silver chlorobromide emulsion (silver chloride, 50 mol%) and 0.36 g of dioctylphthalate wherein 0.42 g of following magenta coupler M-2 and 0.015 g of HQ-1 are dissolved.

layer 4: a second intermediate layer containing 1.9 g of gelatin, and 0.5 g of dioctylphthalate wherein 0.02 g of HQ-1 and 0.7 g of UV absorbing agent UV-1 are dissolved.

layer 5: a red-sensitive emulsion layer containing 1.5 g of gelatin, 0.027 g of red-sensitive silver chlorobromide emulsion (silver chloride, 50 mol%) and 0.35 g of dioctylphthalate wherein 0.4 g of following cyan coupler C-1, 0.01 g of HQ-1 and 0.3 g of UV absorbing agent UV-1 are dissolved.

layer 6: a protective layer containing 1.4 g of gelatin.

Y-2

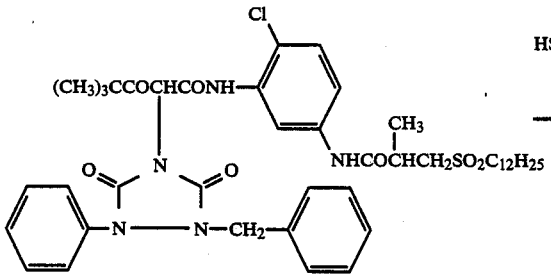

M-2

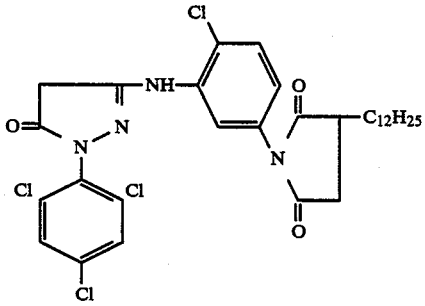

UV-1

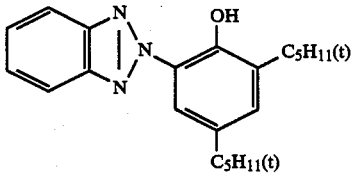

C-1

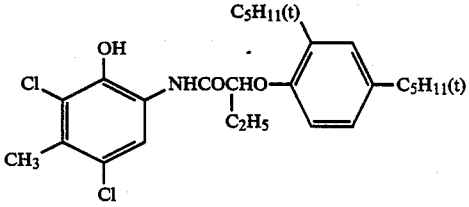

Incidentally, fog restraining agents shown in Table 3 were added to silver chlorobromide emulsion in layer 1, 3 and 5 in the ratio of 0.05 mol of fog restraining agent per mol of silver halide. Electron-beam hardening resin coated paper described in Japanese Patent O.P.I. Publication No. 174980/1983 was used.

Color photographic light-sensitive materials, after being preserved for one year at 25° C., were processed in the same way as Example 1 and the fog density in each layer sensitive for each color was measured. The results thereof are shown in Table 3.

TABLE 3

| Sample No. | Support | Compound added | Fog density instant R | G | B | passage of time R | G | B |
|---|---|---|---|---|---|---|---|---|
| 33 | Polyolefin laminated paper | Comparative 5 | 0.03 | 0.06 | 0.09 | 0.05 | 0.09 | 0.08 |
| 34 | Polyolefin laminated paper | Exemplified V | 0.03 | 0.05 | 0.09 | 0.05 | 0.07 | 0.13 |
| 35 | Electron-beam hardening resin coated paper | Comparative 5 | 0.04 | 0.03 | 0.05 | 0.27 | 0.26 | 0.38 |
| 36 | Electron-beam hardening resin coated paper | Exemplified V | 0.03 | 0.03 | 0.05 | 0.04 | 0.05 | 0.07 |

Comparative compound 5

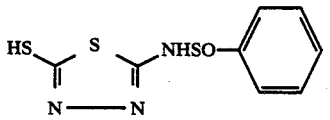

As obvious from the results of Table 3, the sample 36 obtined by the combination in the present invention shows the lowest fog density and a remarkably high stability for the storage-especially for long period of time.

What is claimed is:

1. A silver halide photographic light-sensitive element comprising a paper support bearing thereon at least one silver halide emulsion layer containing a hydroxytetrazaindene compound represented by the Formula [I] or [II]

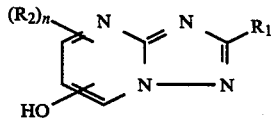

Formula [I]

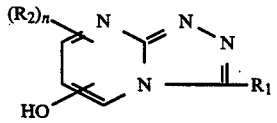

Formula [II]

wherein, $R_1$ and $R_2$ individually represent hydrogen, an aliphatic group or an aromatic group; n is an integer of 1 or 2, said compound being present in an amount of 0.001 to 0.5 mols per mol of silver halide in said silver halide emulsion layer; and a resin layer interposed between said paper support and said silver halide emulsion layer, said resin layer consisting essentially of an electron beam-hardenable component comprising a prepolymer having at least two ethylenic unsaturated double bonds.

2. The silver halide photographic light-sensitive element of claim 1 wherein said silver halide emulsion layer comprises 0 to 70 mole % silver bromide and 30 to 100 mole % silver chloride.

3. The silver halide photographic light-sensitive element of claim 1 wherein said hydroxytetrazaindene compound is 4-hydroxy-6-methyl-1,3,3a,7-tetrazaindene.

4. The silver halide photographic light-sensitive element of claim 1 wherein said electron beam-hardenable component consists essentially of at least three kinds of prepolymers, each having at least two ethylenic unsaturated double bonds.

5. The silver halide photographic light-sensitive element of claim 4 wherein said electron beam-hardenable component consists essentially of 40 to 80 mol % of a first prepolymer having at least two ethylenic unsaturated double bonds and a second prepolymer having at least three ethylenic unsaturated double bonds.

* * * * *